United States Patent [19]

Pickett et al.

[11] 4,400,114

[45] Aug. 23, 1983

[54] EARTH ANCHOR APPARATUS AND METHOD

[75] Inventors: Teddy L. Pickett, Ventura, Calif.; Jerry L. Edwards, Marietta, Ga.

[73] Assignee: The United States of America as represented by the Secretary of Agriculture, Washington, D.C.

[21] Appl. No.: 345,455

[22] Filed: Feb. 3, 1982

[51] Int. Cl.[3] ..... E02D 5/74

[52] U.S. Cl. ..... 405/303; 405/244; 405/263; 52/159

[58] Field of Search ..... 405/258-262, 405/184, 244, 303; 52/153-155, 157-161; 114/293

[56] References Cited

U.S. PATENT DOCUMENTS

| | | | |
|---|---|---|---|
| 362,774 | 5/1887 | Nevison | 52/159 |
| 812,003 | 2/1906 | Blackburn | 52/159 |
| 961,438 | 6/1910 | Goldsborough | 405/244 X |
| 1,026,402 | 5/1912 | Marshall et al. | 52/159 |
| 1,643,769 | 9/1927 | Heinrich | 52/159 |
| 1,742,162 | 12/1929 | Birkenmaier | 52/159 |
| 1,838,745 | 12/1931 | Croney | 52/155 |
| 1,869,744 | 8/1932 | Goldenstar | 52/159 |
| 2,878,649 | 3/1959 | Jacobs | 52/159 X |
| 3,056,477 | 10/1962 | Wooley | 52/160 |
| 3,778,944 | 12/1973 | Easley | 52/159 |

*Primary Examiner*—Dennis L. Taylor
*Attorney, Agent, or Firm*—M. Howard Silverstein; David G. McConnell

[57] ABSTRACT

An apparatus and method for installing an extending plate earth anchor using extension plates, a hydraulic jack which works against the side of the wall, and techniques for load stress distribution are shown and described.

10 Claims, 3 Drawing Figures

EARTH ANCHOR APPARATUS AND METHOD

BACKGROUND OF THE INVENTION

1. Field of the Invention

This invention relates to a method and apparatus for securing cables into the ground by means of an improved earth anchor. Earth anchors depend upon the weight of the earth above the anchor and the sheer strength of undisturbed soil which lies above extensions of the anchor. The holding strength is dependent upon the size of the anchor, the depth and the amount of undisturbed earth that secures the anchor.

Earth anchors are used for securing guy lines for transmission poles, logging towers and drilling platforms. They may also be used for any other purpose that requires securing an object to the ground.

2. Description of the Prior Art

In earth anchors known in the art, many complex mechanical devices have been used to drive extensions into undisturbed soil. Many do not achieve a high percentage of earth penetration because the extension plates are small. The prior art anchors fail to utilize the side walls of the hole to absorb the reaction to the thrust during insertion of an extension, and as a result require extensive torques which must be applied from the surface.

U.S. Pat. No. 3,778,944 shows an extension which requires rotation of a rod 13. This device produces less than 75% of a surface increase.

U.S. Pat. No. 3,628,337 has small extension members and is therefore limited in strength.

U.S. Pat. Nos. 825,587 and 1,643,769 extend plates by means of gears and a torque rod that extends to the surface. Substantially all of the extension apparatus must remain with the anchor.

U.S. Pat. No. 1,026,402 shows an anchor which requires the extensions to be driven outwardly by means of a wedge driven down.

U.S. Pat. No. 362,774 shows extensions which are driven by a conical wedge pulled upward.

U.S. Pat. No. 2,660,276 is similar to U.S. Pat. No. 3,628,337 and the extensions are small in area.

U.S. Pat. No. 1,994,520 drives the extensions outward by means of vertical impact.

U.S. Pat. No. 1,546,327 depends upon a vertical force to drive the extensions outward.

SUMMARY OF THE INVENTION

This invention differs from the prior art in that it utilizes a hydraulic jack which is manually placed in the hole to push the extensions into the soil. By this technique it is possible to achieve increases in load bearing surface as much as 250%, which is far more than that shown in any of the prior art patents discussed above.

This anchor is much larger than those shown in the art. The anchor therefore includes a flux limiter and a cable attachment means which aids in distributing the heavy loads. The anchor of this invention, because of its larger size and high load bearing surface, can be mounted in shallow holes and therefore in locations where there is a subsurface rock or water condition.

The cable is attached to the anchor assembly at a plurality of locations in order to distribute the load and decrease stress in the assembly.

The strength to weight ratio is substantially improved by the flex limiter and the cable attachment at a plurality of points.

The installation of this anchor is with commonly available hand tools such as wrenches and a hydraulic jack. Once installation is complete, the tools are removed from the hole.

The method of this invention includes excavation of a hole slightly larger than the base plate to a depth of three to five feet, placement of thrust washers in the bottom of the hole with the slots aligned with the long axis of the hole and open toward the center, positioning of a base plate on the bottom of the hole above the thrust washers, placement of a first extending plate between base plate flanges on top of the base plate with the extending plate jack lug extending upwards; attachment of the cable to the jack lug extension, positioning the wall bearing plate and jack in position, jacking the extension plate into the undisturbed soil, installing a second extension plate, attachment of eye bolts to the plates and the thrust washers on each side of the base plate, attachment of the cables to the eye bolts and backfilling the hole.

DESCRIPTION OF THE PREFERRED EMBODIMENT

A. THE APPARATUS

Figure 1:
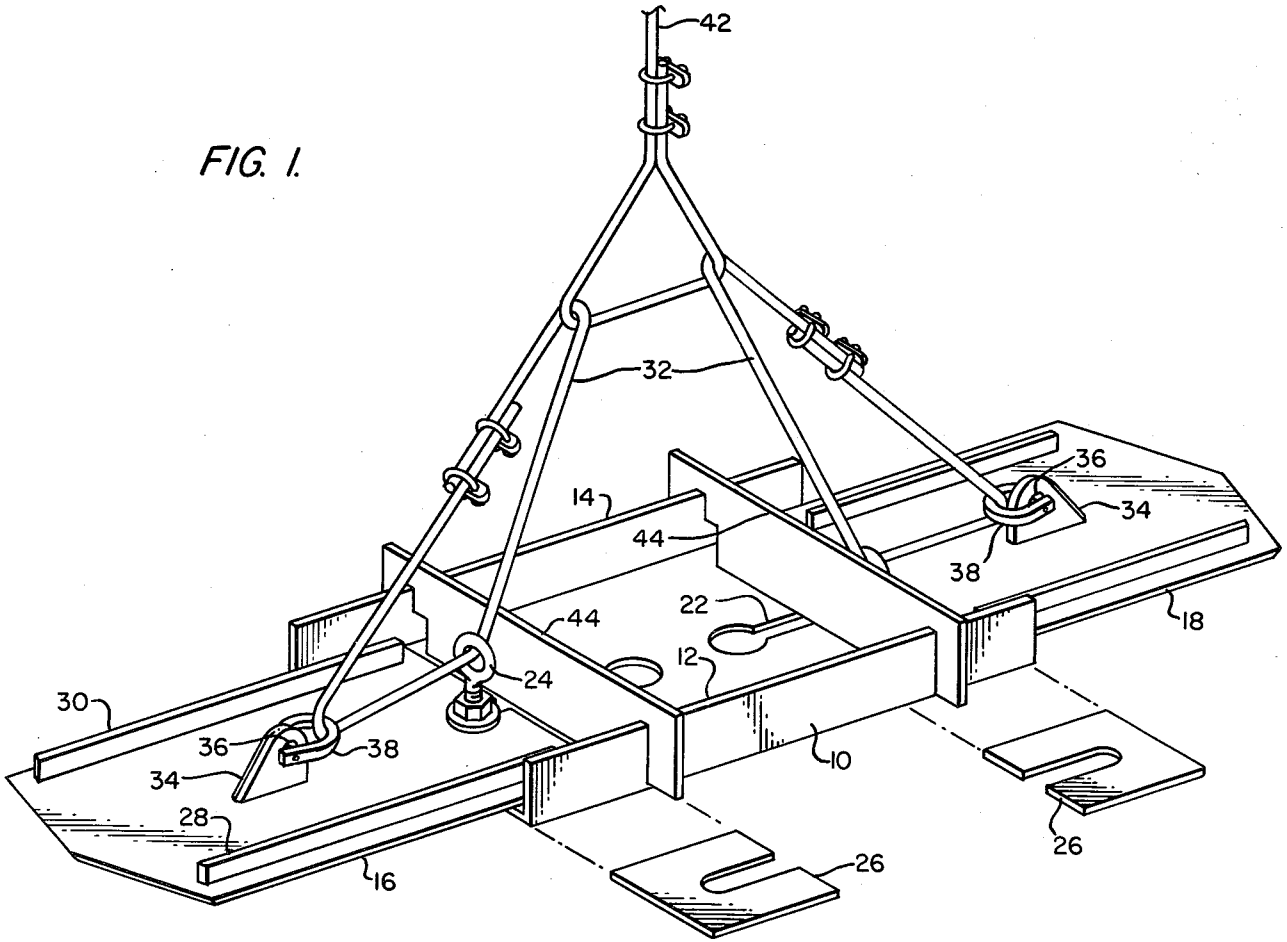
FIG. 1 shows the assembly completed with the cable loops in place.

The extending plate anchor assembly of FIG. 1 includes a base plate 10 which is a rectangle of approximately the size of the hole to be excavated. The base plate 10 has flanges 12 and 14 which extend upwardly from the base plate. Flanges 12 and 14 stiffen the base plate and provide a guide channel which is used during the jacking of extensions 16 and 18 into place. The base plate also includes slots 20 and 22 which are open at the center end in order to permit insertion of eye bolt assemblies 24 and alignment of the extension plates 16, 18.

Thrust washers 26 are initially placed in the hole with centers pointing in the same direction as slots 20 and 22 and towards the center of the hole. These thrust washers are attached to the eye bolt assemblies upon final assembly and serve to distribute the eye bolt forces over a large area of the base plate 10.

The extension plates 16, 18 have upwardly extending flanges 28 and 30 which stiffen the plates when force is applied to the cable assembly 32. The upwardly extending flanges also serve to guide the extension plate through the soil during insertion.

The extension plates 16, 18 have jack lug extensions 34 with holes 36 for receiving cable shackles 38. The jack lug extensions are adapted to receive the end of a jack 40 as shown in FIG. 2.

A cable 32 is attached to the eye bolt assembly 24 and the cable shackle 38. As can be seen in FIG. 1, when the cable 42 is drawn tight, the load is distributed to two points on each side of the assembly. This reduces stress and flexure of the completed anchor assembly.

A flex limiter 44 is placed across each end of the base plate 10 after the eye bolts 24 are tightened. These flex limiters become functional only when high loads are placed on cable 42, causing base plate 10 to flex, moving flanges 12 and 14 apart.

Figure 2:
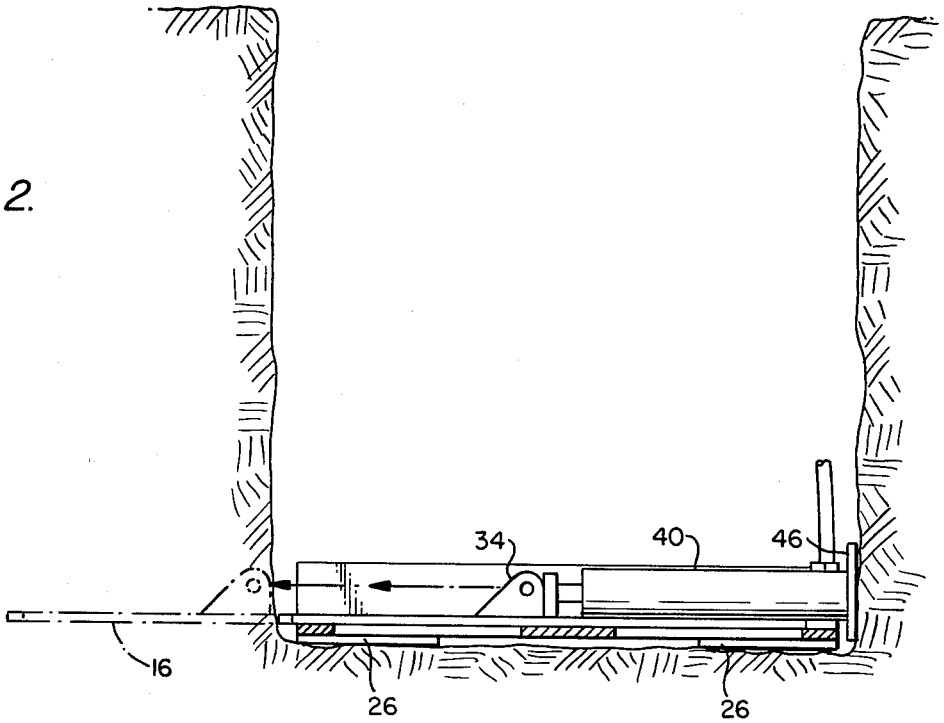
FIG. 2 shows the base plate and extension plate in the hole with the jack and the wall bearing plate in place.
Figure 3:
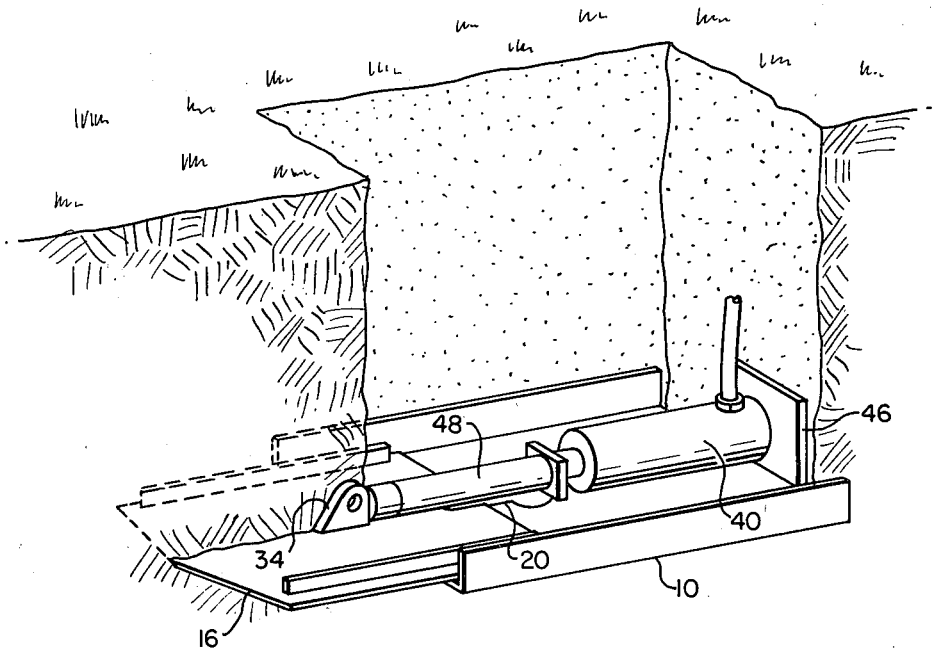
FIG. 3 shows the jack, with an extension in place after the thrust plate has been inserted into undisturbed soil, but without the cable attached to the lug.

Assembly is commenced as shown in FIG. 2 where jack 40 is placed between the jack lug 34 and a wall bearing plate 46 which is placed on the opposite side of the hole. When the jack 40 is extended, extension plate 16 moves into the soil. If the travel of the extension plate exceeds the travel of the jack, then jack extensions 48 as shown in FIG. 3 may be used to finally place the extensions in the soil. The extensions are inserted until the jacking lug becomes embedded in the soil.

In the preferred embodiment, the jack 40 is a hydraulic cylinder or a porta power cylinder. Obviously any other mechanical or pneumatic jack may be employed which will conveniently fit into the hole. The pump may be a hand pump or any other source of hydraulic power.

During insertion of the extension plates, it may be necessary to temporarily bolt the extension plates lightly to the base plate in order to maintain alignment and prevent excessive cocking. This stop bolt is not shown and is removed after the plate insertion step.

At final assembly the thrust washers 26 are rotated so that their slots 27 are at an angle to slots 20 and 22 of the base 10 in order to provide for even load distribution.

B. THE METHOD OF ANCHORING

The method of anchoring basically utilizes a jack against an extension plate which acts against the side of a hole in the ground and a system for locking the base plate and extension plates together after insertion.

The method involves excavation of a hole which is slightly larger than the base plate 10, placing thrust washers 26 in the hole with their open ends facing the center, placing the base plate 10 in the hole, placing the extension plate 16 on the base plate between flanges 12 and 14, placing a jack 40 and wall plate 46 in the hole as shown in FIG. 2, attaching a cable to the jack lug 34 by shackle 38, extending the jack 40 until the jack lug 34 is flush with the side of the hole, repeating the extension plate-jacking procedure on the opposite side of the hole, removal of the jack 40 attachment of eye bolts 24 and cable 32, thereby securing the cable and locking the plate assembly together, and backfilling the hole.

From the above description it can be seen that this invention provides an inexpensive, strong and easy to install earth anchor apparatus and method.

What is claimed is:

1. An extending plate earth anchor assembly for anchoring a cable at the bottom of a hole in the earth comprising in combination:

(a) a base plate;

(b) extension plates having jack lug extensions;

(c) means for locking said base plate and said extension plates together when the base plate-extension plate assembly is completed;

(d) a removable jack means for jacking said extension plates into the sides of said hole having a first end connected to one of said extension plate jack lug extensions;

(e) a removable wall bearing plate means placed between a second end of said jack means and a side of said hole for distributing the force of said jack means on the hole side wall; and (f) cable attachment means connected to said base plate-extension plate assembly.

2. The apparatus of claim 1 wherein said base plate includes upwardly extending flange members which prevent flexing of said plate and provide guide means for said extension plates when the extension plates are jacked into the side of the hole.

3. The apparatus of claim 2 further including a flex limiting plate means adapted to span the space between said base plate flange members for limiting the flex of said base plate.

4. The apparatus of claim 1 wherein said cable attachment means includes holes in said jacking lugs and lifting eyes.

5. The apparatus of claim 1 wherein said base plate and said extension plates each have elongated slots for receiving said locking means during assembly completion.

6. The apparatus of claim 1 wherein said jack is a hydraulic cylinder jack having extension members.

7. The method of installing an extending plate earth anchor in a hole comprising the steps of:

(1) excavation of a hole in the ground;

(2) inserting in the hole a base plate;

(3) placing a first extending plate on top of said base plate, said extending plate having a jacking lug extending upward;

(4) positioning a wall bearing plate means on the side of said hole opposite from said jacking lug on said extending plate;

(5) placing a jack means between said wall bearing plate and said jacking lug;

(6) jacking said extension plate into the side of said hole;

(7) removing said jack and wall bearing plate from said hole;

(8) placing one or more additional extending plates in said hole by repeating steps 3 through 6; and (9) locking said base plate and said extending plates together to form a base plate-extension plate assembly; and

(10) attachment of a cable to said base plate-extension plate assembly.

8. The method of claim 7 further including the step of inserting thrust washers under said base plate after Step 2 and before Step 3.

9. The method of claim 7 further including the step of placing flex limiting plates across upwardly extending flanges on said base plate after the base plate-extension plate assembly is complete.

10. The method of claim 7 further including the step of attachment of the cable to said jack lug extensions before jacking said extension plate into the side of said hole.

* * * * *